US005198719A

United States Patent [19]

Koh

[11] Patent Number: 5,198,719

[45] Date of Patent: Mar. 30, 1993

[54] ELECTRON GUN FOR COLOR CATHODE-RAY TUBE

[75] Inventor: Nam J. Koh, Kyungsangbook-Do, Rep. of Korea

[73] Assignee: Goldstar Co., Ltd., Seoul, Rep. of Korea

[21] Appl. No.: 802,519

[22] Filed: Dec. 5, 1991

[30] Foreign Application Priority Data

Dec. 5, 1990 [KR] Rep. of Korea ..... 19955/1990

[51] Int. Cl.[5] ..... H01J 29/51; H01J 29/62

[52] U.S. Cl. ..... 313/414; 313/412

[58] Field of Search ..... 313/414, 412

[56] References Cited

U.S. PATENT DOCUMENTS 4,523,123 6/1985 Chen .

4,701,678 10/1987 Blacker et al. .

FOREIGN PATENT DOCUMENTS 0225245 6/1987 European Pat. Off. .

OTHER PUBLICATIONS

Abstract of Japan, vol. 8, No. 59 (E-232)(1496) Mar. 17, 1984.

Abstract of Japan, vol. 14, No. 154 (E-907)(4097) Mar. 23, 1990.

*Primary Examiner*—Palmer C. DeMeo

[57] ABSTRACT

An electron gun for a color cathode-ray tube for enhancing the convergence characteristics and removing the flare of beam spot formed at the boundary of screen, includes first and second grid electrodes and a first accelerating and focusing electrode each having first, second and third electron beam passing holes for allowing first, second and third electron beams emitted from cathodes to pass therethrough so as to be accelerated and focused; first and third slots formed around the first and third electron beam passing holes and having asymmetrical depth for allowing equipotential intervals at inner side to be larger than equipotential intervals at outer side, the first and third electron beam passing holes being symmetrical to each other with respect to the second electron beam passing hole; and a second slot formed around the second electron beam passing hole and provided with a symmetrical depth so as to have same equipotential interval at its inner and outer side with respect to the center of the second electron beam passing hole.

3 Claims, 4 Drawing Sheets

ELECTRON GUN FOR COLOR CATHODE-RAY TUBE

BACKGROUND OF THE INVENTION

1. Field of the Invention

The present invention relates to an electron gun for a color cathode-ray tube for enhancing convergence by efficiently focusing electron beams emitted from three cathodes of in-line alignment on a fluorescent screen and removing the flare of a beam spot which is produced around the fluorescent screen of the color cathode-ray tube in terms of the deflection magnetic field for self-convergence.

2. Description of the Prior Art

In general, several types of color cathode-ray tubes are known in the art. One of the color cathode-ray tubes is structured, as shown in FIG. 1, such that three electron beams Bs, Bc and Bs are emitted from an electron gun 2 contained in a neck portion 1 in the rear of a glass bulb and focused on a point of a shadow mask 3, and then combined with R.G.B. colors so as to reproduce desired images on a fluorescent screen 5 which is on the internal surface of a panel 4.

The electron gun 2 is of an in-line type for emitting three electron beams in parallel with the axis (A—A) of the color cathode-ray tube, and must have an electron beam focusing structure in order to focus the three parallel beams on one point of the fluorescent screen.

FIGS. 2 and 3 illustrate an electron gun 2 which is generally applied to a conventional color cathode-ray tube. As shown in FIGS. 2 and 3, the electron gun comprises three cathodes 7 each having a heater 6 therein, first and second grid electrodes 8 and 9, a first accelerating and focusing electrode 10 each of which has three electron beam passing holes 81, 82, 83, 91, 92, 93, 101, 102 and 103 being spaced from each other as much as a predetermined distance S and aligned in the same axial line, and second accelerating and focusing electrode 11 of which a central electron beam passing hole 112 is aligned in the same axial line as the electron beam passing holes 82, 92 and 102 of the first and second grid electrodes 8 and 9 and first accelerating and focusing electrode 10 and side electron passing holes 111 and 113 are aligned eccentrically to the electron beam passing holes 81, 83, 91, 93, 101 and 103 of the first and second grid electrodes 8 and 9 and first accelerating and focusing electrode as much as a predetermined distance ΔS toward the outer side. In the above structure, the amount of eccentricity ΔS is determined such that the diameters of the electron beam passing holes 111 and 113 of the second accelerating and focusing electrode 11 are larger than or the same as the diameters of the electron beam passing holes 101 and 103 of the first accelerating and focusing electrode 10, and the distance S' between the electron beam passing holes of the second accelerating and focusing electrode 11 is larger than the distance S between the electron beam passing holes of the first accelerating and focusing electrode 10.

FIG. 4 shows a conventional convergence structure in which the electron beam passing holes 101, 103 and 111, 113 of the first accelerating and focusing electrode 10 and the second accelerating and focusing electrode 11 are formed in with an amount of eccentricity ΔS. When a voltage is applied from the outside of the electron gun 2, equipotential lines V1, V2 . . . , which are called a main electron lens are formed, for focusing the electron beams Bs, Bc and Bs at a space between the first and second accelerating and focusing electrodes 10 and 11 so that a plurality of electron beams which are emitted from the cathodes 7 can be focused on the fluorescent screen as a beam spot. The equipotential lines at the second accelerating and focusing electrode 11 are formed asymmetrically with respect to the electron beam path between the electron beam passing holes 101, 103, 111, and 113, by the eccentricity ΔS.

Accordingly, the electron beam Bs which passes through the above path advances refractively toward the central beam Bc as much as a predetermined angle $\theta'$ by an equation of refraction and then focused on a point on the fluorescent screen 5.

Meanwhile, the main electron lens formed between the first accelerating and focusing electrode 10 and the second accelerating and focusing electrode 11 has to focus respective electron beams and converge the side beams Bs. However, in practice since the refractive index of the main electron lens is varied when the focusing voltage is adjusted to enhance the focusing characteristics, the shape of the equipotential lines between the electron beam passing holes 101, 103, 111 and 113 also varies. As a result, the focusing characteristics are varied so that the two requirements as above cannot be satisfied. In addition, since the convergence rate must be varied depending upon the size of the color cathode-ray tube, there occurs a problem in that the eccentricity ΔS must be adjusted properly in correspondence with the size of the color cathode-ray tube, and also a further problem occurs in that the number of parts of the second accelerating and focusing electrode 11 is large so that the workability for assembling the electron gun becomes lower.

Furthermore, in the color cathode-ray tube which adopts a circular symmetrical lens system, although a thin and round beam spot can be obtained at the center of the fluorescent screen by a strong quadruple magnetic field within a color cathode-ray tube having a deflection yoke of non-uniform magnetic field for self-convergence, a flare with a low electronic density is formed at the circumferentical portion of the beam spot so that the focusing characteristics are deteriorated and thus the resolution of the color cathode-ray tube becomes lower.

Self-convergence is a method for directing three electron beams to focus on a point by deflection of electron beams even at the circumferential portion of the screen of a color cathode-ray tube. That is, the magnetic forces applied to three electron beams form non-uniform magnetic fields by means of the deflection yoke positioned just before the electron gun 2 as shown in FIG. 1. By such an arrangement, although the self-convergence characteristics may be obtained, it is inevitable that the focusing characteristics of electron beams become deteriorated.

Considering the problems mentioned above, an electron gun with a convergence structure as shown in FIGS. 5A and 5B has been proposed.

In such a type of electron gun, the second grid electrode 9 has longitudinal slots 94, 95 and 96 each of which has the same width as that of electron beam passing holes 91, 92 and 93. The slot 95 is positioned symmetrically with respect to the central electron beam passing hole 92 while other two slots 94 and 96 are eccentric with respect to the center of the side passing holes 91 and 93.

In FIG. 5A, the electron beam passing holes 101, 102 and 103 of the first accelerating and focusing electrode 10 and the electron beam passing holes 91, 92 and 93 of the second grid electrode 9 a conventional electron beam convergence structure are disposed in the same axial line, and the dimension of the slots 94, 95 and 96 in lengthwise is determined by the equation $l1+l2=2l3$ and $l2>l1$.

According to this type of the conventional electron beam convergence structure, the equipotential lines V1, V2 . . . are formed asymmetrically on the slots 94 and 95 of the second grid electrode 9 which are disposed asymmetrically around the electron beam passing holes 91 and 93.

That is, at the outer position l1 where the length of the slot is short with respect to the center of the electron beam passing hole, the gradient of the equipotential lines is abrupt, while at the inner position l2 where the length of the slot is large the gradient thereof is gradual. The electron beams Bs which have been passed through the side electron beam passing holes 91 and 93 pass through the second grid electrode 9 are then converged into the central beam by refracting toward a center axis at a predetermined angle $\theta$.

The electron gun 2 having a convergence structure at the second grid electrode 9 achieves good convergence characteristics because the convergence structure between the first accelerating and focusing electrode 10 and the second accelerating and focusing electrode 11 compensates for the convergence deterioration caused by a variation of a convergence voltage. And, also since the slots 94, 95 and 96 strengthen the focusing operation in the breadthwise direction and deteriorates focusing in the longitudinal direction, the electron beams Bs, Bc and Bs passing through the passing holes 91, 92 and 93 are strongly focused in the breadthwise direction so that a longitudinally extended electron beam is formed and then neutralized with an inverse quadruple magnetic field while passing through the main electron lens and the asymmetric magnetic field for self-convergence, thereby forming a beam spot of low density and low flare on the fluorescent screen, resulting in increased resolution of the color cathode-ray tube.

However, the above-mentioned second grid electrode 9 as shown in FIGS. 5A and 5B has a disadvantage in the manufacturing thereof.

That is, since the slots 94 and 96 are formed eccentrically with respect to the passing holes 91 and 93, the manufacturing of a mold for the eccentric slots is difficult and also it is very difficult to adjust the amount of eccentricity precisely in the pressing work. Furthermore, since the dimensions of the slots must be changed in accordance with the size of the color cathode-ray tube, additional molding work is required in each case.

SUMMARY OF THE INVENTION

Accordingly, it is an object of the present invention to provide an electron gun for a color cathode-ray tube having a second grid electrode which is capable of being easily manufactured and applicable to various color cathode-ray tubes irrespective of the size of the cathode-ray tube, which eliminates the above problems encountered in a conventional color cathode-ray tube.

Other objects and further scope of applicability of the present invention will become apparent from the detailed description given hereinafter. It should be understood, however, that the detailed description and specific examples, while indicating preferred embodiments of the invention, are given by way of illustration only, since various changes and modifications within the spirit and scope of the invention will become apparent to those skilled in the art from this detailed description.

Briefly described, the present invention relates to an electron gun for a color cathode-ray tube which comprises a second grid electrode and a first accelerating and focusing electrode wherein electron beam passing holes are aligned in the same axial line, longitudinal slots of the second grid electrode are formed symmetrically with respect to corresponding electron beam passing holes, the depth of the slots at both sides are the same as that of the central passing hole at their inner sides, and the depth of the slots on both sides is smaller than that of the central passing hole.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DESCRIPTION OF THE PREFERRED EMBODIMENTS

Figure 1:
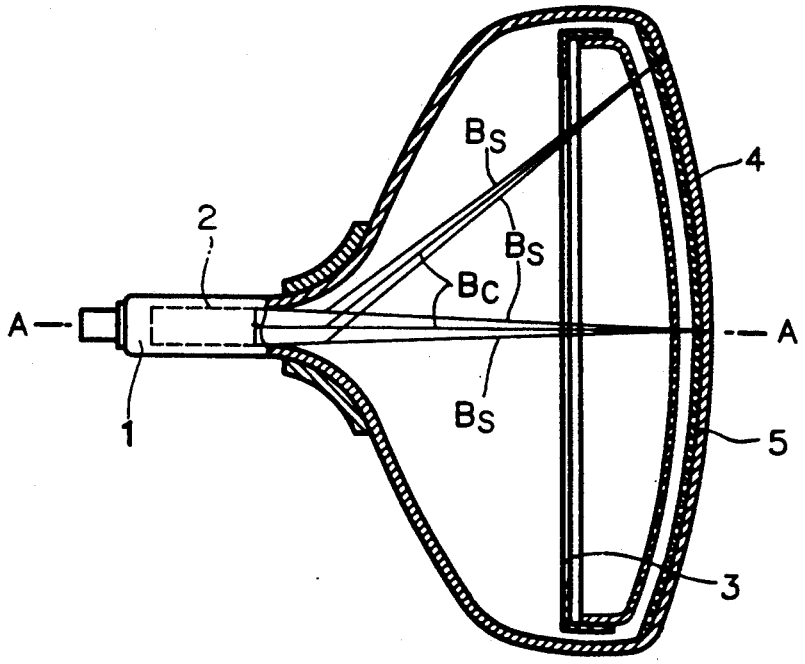
FIG. 1 PRIOR ART
FIG. 1 is a longitudinal sectional view of a conventional color cathode-ray tube.
Figure 2:
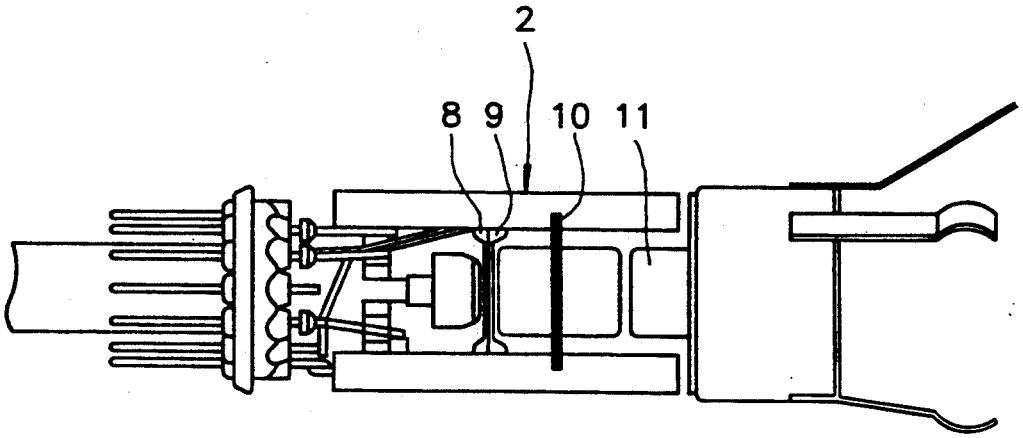
FIG. 2 PRIOR ART
FIG. 2 is a longitudinal sectional view of an electron gun of FIG. 1.
Figure 3:
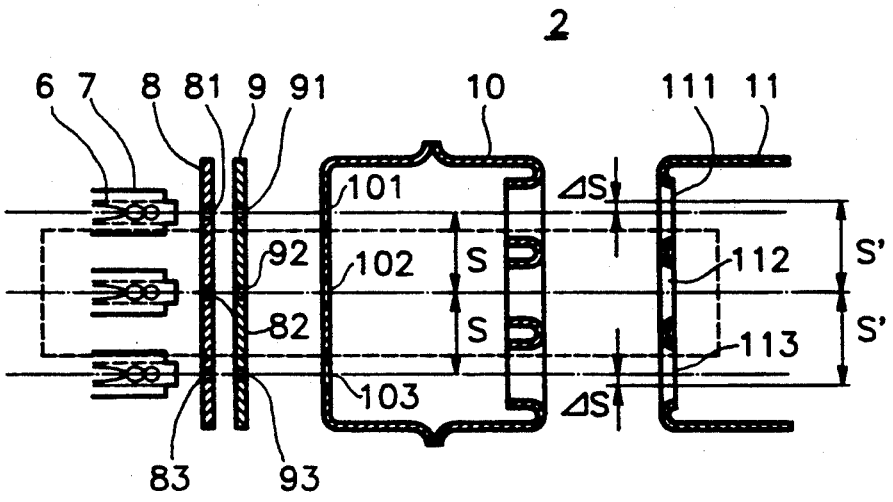
FIG.3 PRIOR ART
FIG. 3 is a schematic sectional view of FIG. 2.
Figure 4:
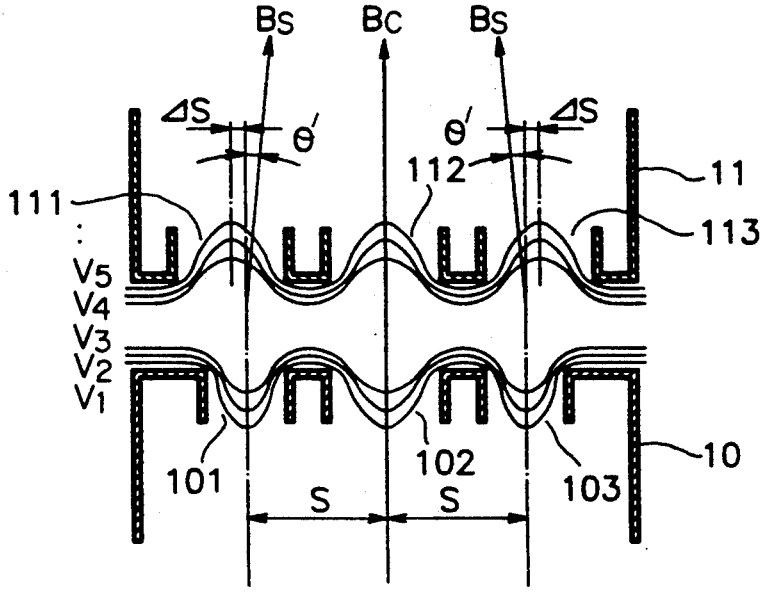
FIG.4 PRIOR ART
FIG. 4 is a longitudinal sectional view of the conventional electron gun in partial showing the electron beam convergence structure.
Figure 5A:
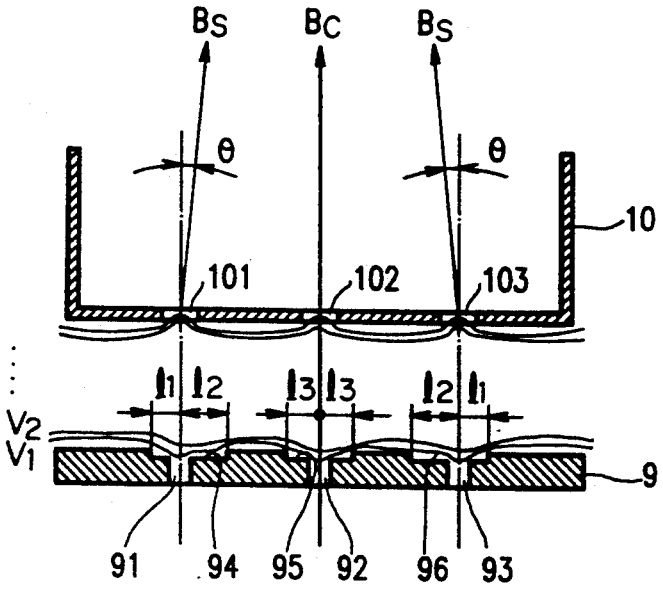
FIG.5A PRIOR ART
FIG. 5A is a longitudinal sectional view of another type of electron gun showing a conventional electron beam convergence structure.
Figure 5B:
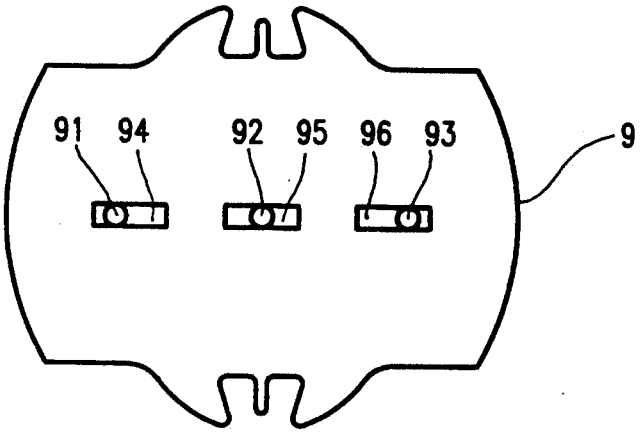
FIG.5B PRIOR ART
FIG. 5B is a plane view of a second grid electrode of FIG. 5A.
Figure 6:
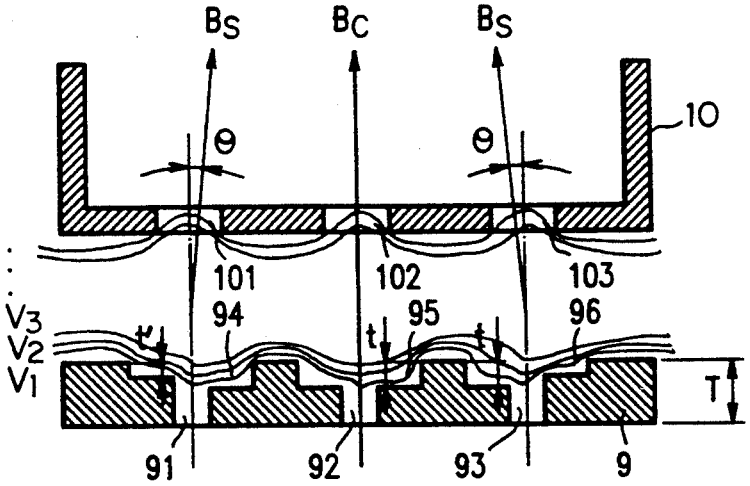
FIG. 6 is a longitudinal sectional view of an electron gun in partial, showing the electron beam convergence structure according to an embodiment of the present invention.
Figure 7:
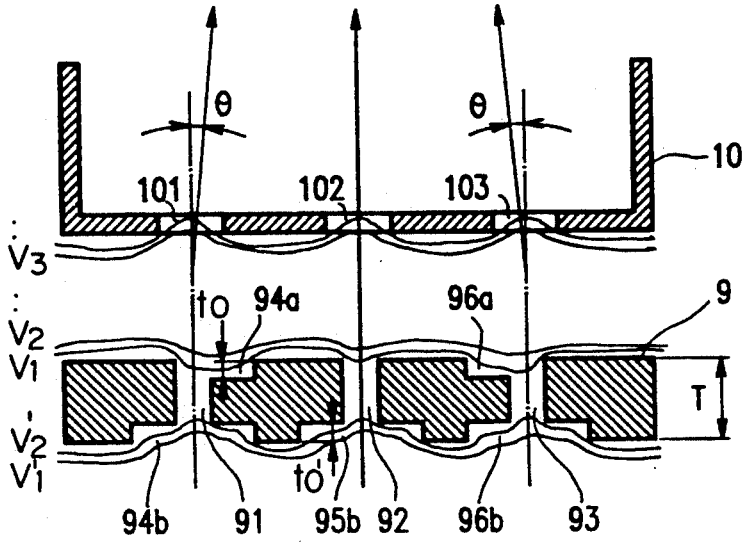
FIG. 7 is a view the same as FIG. 6, but showing another embodiment of the present invention.

Referring now in detail to the drawings for the purpose of illustrating preferred embodiments of the present invention, the electron gun of the present invention is similar in structure to that in FIGS. 1 to 3, but the structure of the second grid electrode 9 is changed as shown in FIGS. 6 and 7. Accordingly, the present invention will now be described in connection with the second grid electrode 9 with reference to the first accelerating and focusing electrode 10.

As shown in FIG. 6, longitudinally extended slots 94, 95 and 96 are formed around electron beam passing holes 91, 92 and 93 of the second grid electrode 9. The width of the slots 94, 95 and 96 is nearly the same as that of the passing holes 91, 92 and 93 and the length thereof is symmetrical with respect to the center of each of the passing holes 91, 92 and 93 and larger than the diameter of each of the passing holes 91, 92 and 93. Furthermore, the depth of the central slot 95 is formed such that the depth(t) at both sides on the basis of the passing hole 92 are the same and has the relationship with the thickness (T) of the second grid electrode 9 of $t \leqq T/2$. And, the depth (t') of each of the slots 94 and 96 is the same as that of the central slot (t) in its inner side, but that in outer side is smaller than the depth (t) of the central slot 95 as $t' < t$.

The second grid electrode 9 is disposed at a certain space from the first accelerating and focusing electrode 10 an the electron beam passing holes 91, 92, 93 and 101, 102, 103 of the second grid electrode 9 and the first accelerating and focusing electrode 10 are aligned in the same axial line.

Referring to FIG. 7, longitudinally extended slots 94*a* and 96*a* are formed only at the inner side of the electron beam passing holes 91 and 93 of the second grid electrode 9 toward the first accelerating and focusing electrode 10, and the depth ($t_0$) of each of the slots 94*a* and 96*a* has the relationship with the total thickness (T) of the second grid electrode 9 as $t_0 < T/2$.

In addition, on the opposite side of the slots 94*a* and 96*a* of the second grid electrode 9, longitudinally extended slots 94*b*, 95*b* and 96*b* are formed around the electron beam passing holes 91, 92 and 93 such that the width thereof is the same as the diameter of the passing holes 91, 92 and 93, and the length thereof is larger than and symmetrical with respect to the center of each of the passing holes 91, 92 and 93. And also the depth ($t_0'$) of the slots 94*b*, 95*b* and 96*b* has the relationship with the total thickness (T) of the second grid electrode 9 as $t_0' \leqq T/4$.

According to the present invention, equipotential lines V1, V2 . . . having an abrupt gradient at their outer side and gradual gradient at their inner side are formed around the electron beam passing holes 91 and 93 at both sides, as shown in FIG. 6, and the electron beams Bs which have been passed through the passing holes 91 and 93 of the second grid electrode 2 are refracted toward the central axis at an angle $\theta$ by the refraction of the asymmetrical equipotential lines V1, V2 and thus converged toward the central beam Bc.

Moreover, since the slots 94, 95 and 96 are formed such that the width thereof is the same as the diameter of the electron beam passing holes 91, 92 and 93 and the length thereof in the longitudinal direction is larger than the diameter of the passing holes 91, 92 and 93, the equipotential lines in the breadthwise direction are abrupt in their gradients so that their converging operation is strong while gradual in the longitudinal direction so that their converging operation is weaker, thereby forming the electron beams Bs and Bc with a longitudinally extended shape.

The electron beams Bs and Bc which have been focused with the longitudinally extended shape, pass through the main electron lens to compensate for the magnetic quadruple operation of the deflection yoke so that the flare of beam spot around the cathode-ray tube is suppressed.

According to the another embodiment of the present invention, as shown in FIG. 7, the longitudinally extended slots 94*a* and 96*a* formed around the passing holes 91 and 93 of the second grid electrode 9 function to converge the electron beams and the longitudinally extended slots 94*b*, 95*b* and 96*b* formed around the passing holes 91, 92 and 93 function to suppress a flare at the circumferential portion of a screen of the color cathode-ray tube.

As described above in detail, the present invention provides the effect that it is possible to increase the convergence characteristics by converging efficiently the three electron beams on a point of the fluorescent screen and to remove the flare which may be produced at the circumferential portion of the screen in terms of the deflection magnetic field for self-convergence. Also, there is provided the effect that the manufacturing of the electrode is made simple by aligning the electron beam passing holes of the second grid electrode and the first accelerating and focusing electrode in the same axial line as well as forming the slots of the second grid electrode symmetrically, thereby being applicable to various types of cathode-ray tubes irrespective of the size thereof.

The invention being thus described, it will be obvious that the same may be varied in many ways. Such variations are not to be regarded as a departure from the spirit and scope of the invention, and all such modifications as would be obvious to one skilled in the art are intended to be included in the scope of the following claims.

What is claimed is:

1. An electron gun for a color cathode-ray tube, comprising:

first and second grid electrodes;

a first accelerating and focusing electrode having first, second and third electron beam passing holes for allowing first, second and third electron beams emitted from cathodes to pass therethrough so as to accelerate and focus the first, second, and third electron beams;

wherein said second electron beam passing hole is centered on a center axis of said color cathode-ray tube;

first and third slots formed around said first and third electron beam passing holes having asymmetrical depth for producing equipotential intervals, on a side closer to the center axis of aid color cathode-ray tube, greater than equipotential intervals, on a side further from the center axis of said cathode-ray tube, said first and third electron beam passing holes being symmetrical to each other with respect to the second electron beam passing hole; and a second slot formed around said second electron beam passing hole having symmetrical depth to produce a uniform equipotential interval with respect to the center axis of said color cathode-ray tube.

2. The electron gun of claim 1, wherein said first and third slots are formed such that a depth of the first and third slots on the side further from the center axis of said color cathode-ray tube is less than a depth of the first and third slots on the side closer to the center axis of said color cathode-ray tube and the depth of the first and third slots on the side closer to the center axis of said color cathode-ray tube is less than half of a thickness of said second grid electrode.

3. The electron gun of claim 1, said second grid electrode including slots around said first and third electron beam passing holes on a side facing said electron gun and symmetrical slots around the first, second and third electron beam passing holes on a side opposite the side facing said electron gun.

* * * * *